US008973568B2

(12) United States Patent
Schönemann et al.

(10) Patent No.: US 8,973,568 B2
(45) Date of Patent: Mar. 10, 2015

(54) GAS OVEN

(75) Inventors: Konrad Schönemann, Sulzfeld (DE); Michael Riffel, Oberderdingen (DE); Uwe Schaumann, Oberderdingen (DE); Wilfried Schilling, Kraichtal (DE); Norbert Gärtner, Ettlingen (DE)

(73) Assignee: E.G.O. Elektro-Gerätebau GmbH, Oberderdingen (DE)

( * ) Notice: Subject to any disclaimer, the term of this patent is extended or adjusted under 35 U.S.C. 154(b) by 623 days.

(21) Appl. No.: 13/279,747

(22) Filed: Oct. 24, 2011

(65) Prior Publication Data

US 2012/0097146 A1 Apr. 26, 2012

(30) Foreign Application Priority Data

Oct. 25, 2010 (DE) ..... 10 2010 042 878

(51) Int. Cl.
*F24C 15/00* (2006.01)
*F24C 15/32* (2006.01)
*F24C 3/00* (2006.01)

(52) U.S. Cl.
CPC ..... *F24C 15/322* (2013.01); *F24C 3/008* (2013.01)
USPC ..... 126/6; 126/4; 126/38 BA; 431/45; 431/51; 136/205

(58) Field of Classification Search
USPC ..... 126/4, 6, 39 BA; 431/45, 51
See application file for complete search history.

(56) References Cited

U.S. PATENT DOCUMENTS

| | | | | |
|---|---|---|---|---|
| 3,786,274 | A | 1/1974 | Saponara | |
| 4,773,847 | A * | 9/1988 | Shukla et al. | 431/46 |
| 6,588,419 | B1 * | 7/2003 | Buezis et al. | 126/500 |
| 2005/0034716 | A1 | 2/2005 | Harbin | |

FOREIGN PATENT DOCUMENTS

| | | | |
|---|---|---|---|
| DE | 1 679 241 | A1 | 3/1971 |
| DE | 200 21 024 | U1 | 3/2001 |
| DE | 10 2008 039 020 | A1 | 2/2010 |
| FR | 2 610 703 | | 8/1988 |
| GB | 2 406 619 | A | 4/2005 |
| JP | 8 210644 | | 8/1996 |
| KR | 2001-0068354 | A | 7/2001 |
| WO | WO 01/70087 | | 9/2001 |
| WO | WO 2006/103613 | A2 | 10/2006 |

OTHER PUBLICATIONS

German Office Action dated Jan. 16, 2012 in DE 10 2010 042 879.7.
European Search Report dated Apr. 11, 2014 in European Application No. EP 11 18 6140.

* cited by examiner

*Primary Examiner* — Avinash Savani
(74) *Attorney, Agent, or Firm* — Lee & Hayes, pllc

(57) ABSTRACT

A gas oven has an oven muffle and a gas burner for said oven muffle. The gas oven has a thermogenerator for generating electrical energy during operation of the gas burner for the purpose of supplying electrical energy to an electrical functional unit, for example for supplying said electrical energy to a fan or a control of the gas oven. In this case, the thermogenerator is designed and arranged to be heated, and for heat to be introduced by the gas burner.

14 Claims, 2 Drawing Sheets

GAS OVEN

CROSS REFERENCE TO RELATED APPLICATIONS

This application claims priority to DE 102010042878.7 filed on Oct. 25, 2010, the contents of which are incorporated by reference for all that it teaches.

FIELD OF APPLICATION

The disclosure generally relates to a gas oven having an oven muffle and at least one gas burner for the oven muffle.

BACKGROUND

Gas ovens having an oven muffle which is heated by a gas burner are generally known. However, gas ovens of this kind exhibit a relatively limited level of convenience.

SUMMARY

The invention is based on the object of providing a gas oven of the kind cited it the introductory part with which problems and limitations of the prior art can be eliminated and the variety of functions of a gas oven can be expanded.

In one embodiment, a gas oven having an oven muffle is provided, having an electrical functional unit and having at least one gas burner for said oven muffle, wherein the gas oven has a thermogenerator for generating electrical energy during operation of the at least one gas burner for the purpose of supplying electrical energy to the electrical functional unit, wherein the thermogenerator is designed and arranged to be heated and for heat to be introduced by said gas burner.

This object is achieved by a gas oven having the features of as claimed herein. Advantageous and further refinements of the invention are the subject matter of the further claims and will be explained in greater detail in the text which follows. The wording of the claims is incorporated in the content of the description by express reference.

BRIEF DESCRIPTION OF THE DRAWINGS

Exemplary embodiments of the invention are schematically illustrated in the drawings and will be explained in greater detail in the text which follows. In the drawings.

DETAILED DESCRIPTION

Figure 1:
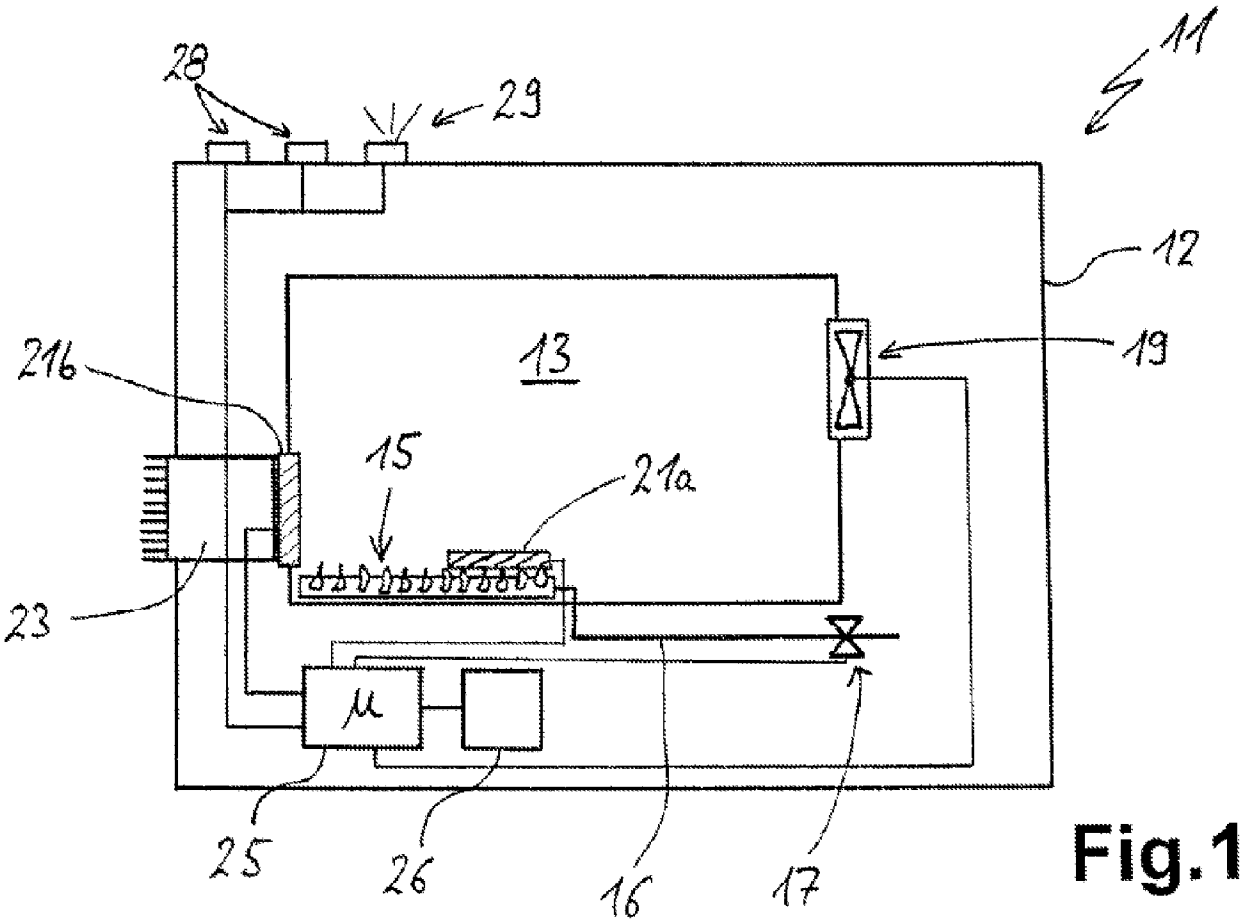
FIG. 1 shows a schematic functional illustration of a gas oven having a gas burner and having a fan in an oven muffle, and also having various mounting options for thermogenerators.

The concepts disclosed herein provide for a gas oven to have a thermogenerator in order to generate electrical energy during operation of at least one gas burner. To this end, as will be explained in greater detail later, the hot side of the thermogenerator is heated by the gas burner, with the thermogenerator being of appropriate design and being arranged on the gas burner or forming a thermally conductive connection with said gas burner. The thermogenerator can then supply or operate an electrical functional unit with the electrical energy it generates. It is therefore possible, by virtue of the invention, to dispense with a separate electrical connection of the gas oven. This firstly means that a gas oven can be positioned in a kitchen or another area more easily and freely. Primarily, it is also possible, as a result, to use a more convenient gas oven of this kind, for example, in remote areas without a connection to a power supply, it being possible to viably operate said gas oven with gas cylinders instead of with a fixed gas line.

In another embodiment, the gas oven has an energy store in which electrical energy which is generated by the thermogenerator can be stored. Rechargeable batteries are suitable for this purpose. As a result, it is primarily possible for electrical energy from the thermogenerator which is not entirely drawn by the electrical functional unit of the gas oven to be stored for times at which the electrical energy which is generated by the thermogenerator possibly may not be sufficient at that time. As an alternative, said electrical energy can be used for functions of the electrical functional unit which are already meant to be available when the gas burner is not yet operating or has been interrupted. This will be explained in greater detail below in respect of the individual functional units.

In another embodiment, the electrical functional unit is an electric fan or a blower. Therefore, a convection mode can be realized in the gas oven in accordance with a conventional convection oven. Therefore, an electrically independent gas oven with a convenient convection function can be provided as a result.

A further embodiment for an electrical functional unit is an electrical or electronic controller of the gas oven instead of a mechanical control means. These are known for electric ovens and can also be adopted for an electrically independent gas oven of this kind without a great deal of modification. An electronic controller can advantageously have electrical operator control elements, in particular so-called touch-operated switches, and also convenient and extensive indicators, in particular indicator lamps. Furthermore, the electronic controller in the form of an electrical functional unit can serve to carry out intelligent cooking processes with targeted influencing of process parameters, for example for automatically switching off the oven at the end of a cooking period.

Further electrical functional units can be in the form of roasting spits with radio transmission for measuring the temperature in a roast or product being cooked, in the form of a lighting means for the oven muffle or the gas oven, advantageously by energy-saving LEDs, or in the form of an ignition module for ignition-module operation of the gas burner or of the gas oven. The convenience and the variety of functions of an electrically independent gas oven can also be improved as a result.

In order to introduce thermal energy into the thermogenerator, provision may advantageously be made for a hot side of the thermogenerator to not only generally face the gas burner, but possibly to be directly acted on by said gas burner during operation of the gas burner. The cold side of the thermogenerator can be cooled either in relation to the area surrounding the gas oven, that is to say to the outside, or in relation to the oven muffle or an oven muffle wall. The very large temperature gradient of more than 600° C. of the gas flame in relation to the ambient temperature can advantageously be used when the cold side is cooled in relation to the area surrounding the gas oven. Therefore, the thermogenerator can either generate a very large amount of electrical energy or else be relatively small. The problem with this may be the subsequent heating of the area surrounding the gas oven and possibly undesired heating in critical regions. Furthermore, the energy which is diverted away by the thermogenerator is lost to the cooking process or the oven muffle.

Furthermore, it is considered to be advantageous to cool the cold side of the thermogenerator in relation to the oven muffle or an oven muffle wall. Since the temperatures which are usually generated in an oven are in the region of around 200° C., it can be assumed that the temperatures in the oven muffle and at the oven muffle walls are not higher than 250° C. Therefore, a temperature gradient of at least 350° C. is available, and this should be large enough to generate the required electrical energy. Furthermore, the energy which is conducted by the thermogenerator is not lost to the heating process either; the gas oven therefore operates in a more energy-efficient manner overall and negative effects on the area surrounding the gas oven can also be avoided.

In a yet further embodiment, the thermogenerator can also be heated by the gas burner, however it cannot be acted on directly by the gas flames. An air duct can be provided in which an air stream for a convection mode of the gas oven is routed. The cold side of the thermogenerator can be acted on by the air stream arriving from the oven muffle and can therefore be, as it were, cooled. Immediately thereafter, the air stream is conducted past the gas burner in a substantially customary manner in order to be heated. The hot side of the thermogenerator is also provided here, advantageously in the form of a wall of a duct for conducting the air stream, and therefore the gas burner also heats the hot side of the thermogenerator, as is desired. Provision may also be made for the thermogenerator to be arranged in an air flow path, as it were, in such a way that its cold side is cooled by said air flow path and its hot side is heated by said air flow path at the same time. The thermal energy which is output on the cold side is then likewise specifically drawn away or, as it were, captured and is not lost to the heating process.

In a yet further embodiment, provision can be made for the gas burner and the thermogenerator to be designed such that the gas burner itself generates, at its minimum power level, precisely that thermal power which, during operation of the gas oven, ensures that the thermogenerator generates enough electrical power to operate the electrical functional unit. This is also advantageous for the described operation with a fan which is supplied with power by the thermogenerator since said fan is also only required when the gas burner is operating. In this case, the gas oven can operate with the fan in the convection mode from the very beginning. As an alternative, provision may be made for the gas oven to first be heated for a period of time and for the thermogenerator to not yet generate enough electrical energy to operate the fan. The fan can start up for the purpose of a convection mode only when this is achieved.

These and further features can be gathered not only from the claims but also from the description and the drawings, where the individual features can be realized in each case by themselves or in combination in the form of subcombinations in an embodiment of the invention and in other fields and can constitute advantageous and inherently patentable embodiments for which protection is claimed here. The subdivision of the application into individual sections and subheadings do not restrict the general validity of the statements made thereunder.

Turning now to the figures, FIG. 1 illustrates a gas oven 11 according to a first embodiment which has a housing 12 and an oven muffle 13 in said housing. The lower region of the oven muffle 13 contains a gas burner 15 having a gas feed line 16 into which a gas valve 17 is looped in order to control the gas supply. In this case, the gas burner 15 can be designed such that no open gas flames can enter the main area of the oven muffle 13. However, this is known to a person skilled in the art in principle and can be implemented by cover plates or the like, and under certain circumstances a kind of intermediate floor is once again provided in the oven muffle 13 above the gas burner 15. In respect of the components described up to this point, the gas oven 11 corresponds to a conventional gas oven and conventional components can advantageously be used.

A fan 19 is schematically illustrated at the top-right of the oven muffle 13, said fan having the function of a conventional fan for a convection oven or fan oven. The fan 19 can draw air by suction from the oven muffle 13 and blow it back again in the manner which is known in principle to a person skilled in the art. However, this will still be explained in greater detail below.

According to one embodiment, a first thermogenerator 21*a* is arranged at the top of the gas burner 15, with said thermogenerator covering only a relatively small portion of the surface of said gas burner. The thermogenerator 21*a* is in the form of a conventional thermogenerator and has a substantially disk-like shape. In this case, said thermogenerator is arranged such that it bears against the gas burner by way of the hot side which is conventional for thermogenerators and is heated by said gas burner so that heat is introduced into the thermogenerator 21*a*. The cold side of said thermogenerator faces the oven muffle 13.

In addition or as an alternative, a second thermogenerator 21*b* can be provided, specifically at the bottom-left of the side wall of the oven muffle 13. The hot side of the thermogenerator 21*a* projects just above the gas burner 15 into the oven muffle 13 or against the gas burner 15. The other side of said thermogenerator is, as the cold side, connected to a thermal conduction component 23 which is routed to an outer wall of the housing 12 and, under certain circumstances, can also be provided with a fan, a heat sink or the like.

In respect of the functioning of the thermogenerator 21*a*, it should be stated that it is acted on by the gas burner 15 with a temperature of over 600° C. on its hot side which faces downward. The maximum temperature which usually prevails in the oven muffle 13 is 200° C. to 300° C., and therefore a temperature gradient of at least 350K is available to the thermogenerator 21*a* for thermal heat transfer. Therefore, enough electrical energy to operate the fan 19 can be generated by corresponding, skilled selection of the materials and the design of the thermogenerator 21*a*. To this end, the thermogenerator 21*a* is connected to a controller 25, such as a microprocess, which has an energy store 26, for example a rechargeable battery. The controller 25 can therefore drive the fan 19 with the electrical energy from the thermogenerator 21*a*. If operation of said fan is desired at the beginning of the process of heating the oven muffle 13, but the thermogenerator 21*a* is not yet delivering enough electrical power, the controller 25 can draw this electrical power from the energy store 26.

In respect of the functioning of the second thermogenerator 21*b*, it should be stated that, depending on how close it is arranged to the gas burner 15, it is acted on partly by the oven temperature of said 200° C. to 300° C. and partly also by the gas burner 15 by way of its hot side which faces to the right. The cold side of said thermogenerator is coupled to the wall of the housing 12 or to the ambient temperature, for example to a heat sink, by the thermal conduction component 23 which conducts heat very well. Therefore, a temperature of usually approximately 20° C. to 30° C. prevails here. This produces a temperature gradient of approximately 200K for the thermogenerator 21*b*, this in turn being sufficient to generate enough electrical power or energy to operate the fan 19. This fan does not have to exhibit a particularly high power, as is known in such fans for convection ovens. However, the second thermogenerator 21*b* has the disadvantages that the surrounding area is unnecessarily or undesirably heated and that energy is drawn from the heating process in the oven muffle 13. It is therefore considered to be advantageous to provide only the thermogenerator 21*a* on the gas burner 15.

The controller 25 is further connected to two operator control elements 28 on the gas oven 11 and to an indicator lamp 29. The operator control elements 28 can be, for example, electronically actuated and evaluated touch-operated switches with which the gas valve 17 for the gas burner 15 is controlled by means of the controller 25, which is permanently supplied with electrical energy by the energy store 26. As an alternative, convenience functions, such as timer functions or the like, can be realized. Therefore, the operator control elements 28 are also one of the options cited in the introductory part for the electrical functional unit of the gas oven which is operated by a thermogenerator. This is also true of the indicator lamp 29 which can be realized, for example, in an energy-saving manner by LEDs.

Figure 2:
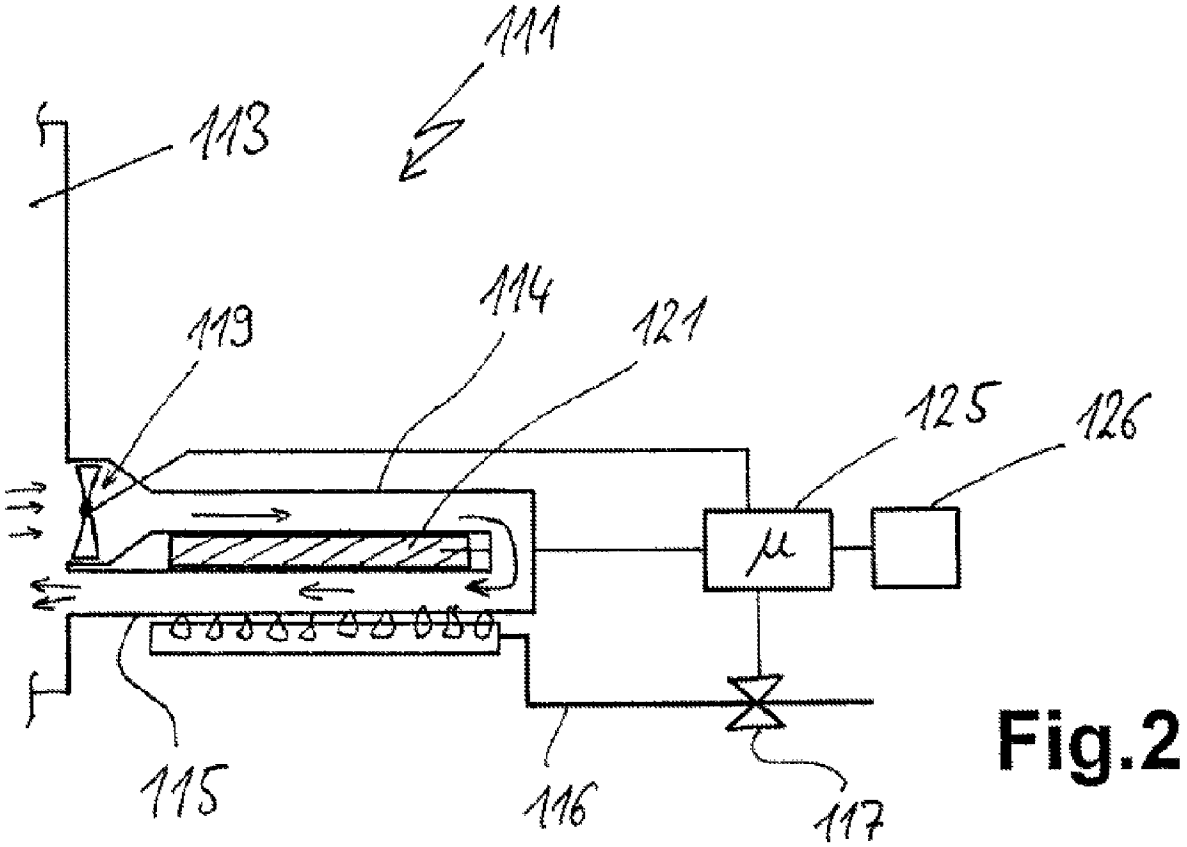
FIG. 2 shows an alternative embodiment of a gas oven having an air duct and a gas burner together with a fan and a thermogenerator.

In the alternative exemplary embodiment of a gas oven 111 according to FIG. 2, a gas burner 115 is not arranged directly in an oven muffle 113 but outside it. An air duct 114 is routed out of the oven muffle 113 and back into said oven muffle in a U-shaped loop. An air stream, which is illustrated using arrows, is generated by a fan 119 at the top-left end of the air duct 114. The gas burner 115 is arranged beneath the lower branch of the air duct 114 and heats up the air flowing through in a conventional manner, said air then being returned to the oven muffle 113. Since cooler air is drawn by suction from the oven muffle 113 in the upper region of the air duct 114 and this air is then returned with a considerably higher temperature after being heated by means of the gas burner 115, it is possible to arrange a thermogenerator 121 between said oven muffle and gas burner. The hot side, which faces downward, of said thermogenerator is heated by or draws heat from the gas burner 115 or the hot air stream in the lower air duct 114. The thermogenerator 121 passes this heat to its upwardly facing cold side in the upper air duct 114 or to its relatively cold air. In particular, the cold side of the thermogenerator 121 is therefore cooled by the fan 119 in this way. A significant temperature gradient can also be generated at the thermogenerator 121, said thermogenerator then generating electrical energy again, this electrical energy being passed to a controller 125 together with an energy store 126 in accordance with FIG. 1.

The fan 119 is also controlled by the controller 125 and supplied with electrical energy by the thermogenerator 121. The energy store 126 serves as an intermediate storage means or an energy buffer store if the controller 125 is also required to operate without operation of the thermogenerator 121 or if the fan 119 is intended to already be in operation even though the gas burner 115 is not yet generating enough electrical energy at the thermogenerator 121.

Therefore, the exemplary embodiments according to FIGS. 1 and 2 can provide electrically independent gas ovens which can provide, without electrical connection, convenience functions for electrical functional units which are normally possible only with power being supplied. Further examples (which are not illustrated here, however) of electrical functional units are a so-called roasting spit with radio transmission and an ignition module for the gas burner, as have been cited in the introductory part. It is readily possible to imagine how they could be provided in addition to the exemplary embodiments described here.

The invention claimed is:

1. A gas oven comprising:

an oven muffle, an electrical functional unit;

at least one gas burner for said oven muffle, wherein said gas oven has a thermogenerator for generating electrical energy during operation of said at least one gas burner for the purpose of supplying electrical energy to said electrical functional unit, wherein said thermogenerator is designed and arranged to be heated and for heat to be introduced by said at least one gas burner; and an electric fan as said electrical functional unit for a convection mode, wherein said electric fan is designed to be supplied with electrical energy by said thermogenerator, wherein said thermogenerator has a cold side, and wherein an air stream which is generated by said fan of said gas oven cools said thermogenerator on said cold side, and wherein said air stream cools said thermogenerator on said cold side in a region just before said air stream is supplied to said at least one gas burner for heating purposes.

2. The gas oven as claimed in claim 1, further comprising an energy store for storing electrical energy which is generated by said thermo generator.

3. The gas oven as claimed in claim 2, wherein said energy store is a rechargeable battery.

4. The gas oven as claimed in claim 1, further comprising: an electronic controller as said electrical functional unit.

5. The gas oven as claimed in claim 4, wherein said electronic controller has electrical operator control elements.

6. The gas oven as claimed in claim 4, wherein said electronic controller is designed to carry out intelligent cooking processes with targeted influencing of process parameters.

7. The gas oven as claimed in claim 1, wherein the electrical functional unit includes at least one of a roasting spit with radio transmission means, LED lighting means, or an ignition module for said at least one gas burner.

8. The gas oven as claimed in claim 1, wherein said thermogenerator has a hot side and said hot side is acted on directly by a flame of a gas burner during operation of said at least one gas burner.

9. The gas oven as claimed in claim 1, wherein said thermogenerator has a cold side that is cooled in one of a surrounding area of said gas oven, in said oven muffle, or a wall of said oven muffle.

10. The gas oven as claimed in claim 1, wherein said thermogenerator has a cold side and a hot side, wherein said gas oven has an air flow path for an air stream, and wherein said cold side of said thermogenerator is arranged in said air flow path in such a way that said cold side is cooled by said air stream which is routed to said at least one gas burner for heating purposes, and that said hot side is heated by a hot air stream which is generated by said at least one gas burner.

11. The gas oven as claimed in claim 10, wherein said hot air stream first runs along said cold side and then, after being heated by said at least one gas burner, along said hot side.

12. The gas oven as claimed in claim 1, wherein said at least one gas burner and said thermogenerator are designed such that said at least one gas burner generates, at a minimum power level, a level of thermal power which said thermogenerator requires to operate said electrical functional unit with said electrical energy it generates.

13. The gas oven as claimed in claim 1, further comprising:

an air duct arranged outside of the oven muffle that directs said convection airflow generated by the electric fan from the oven muffle to a cold side of said thermogenerator, where a hot side of said thermogenerator being heated by said at least one gas burner.

14. The gas oven as claimed in claim 13, wherein the air duct arranged outside of the oven muffle directs said convection airflow generated by the electric fan from the cold side of said thermogenerator to be heated by the at least one gas burner, and then directs said heated convection airflow back into the oven muffle.

* * * * *